US010556147B2

(12) United States Patent
Zhang et al.

(10) Patent No.: US 10,556,147 B2
(45) **Date of Patent: *Feb. 11, 2020**

(54) JUMP ROPE HANDLES INCLUDING SYSTEMS AND METHODS THEREOF

(71) Applicant: Web Guidz, LLC, Wenatchee, WA (US)

(72) Inventors: Neng wen Zhang, Dongguan (CN); Matthew Thomas Hopkins, Leavenworth, WA (US)

(73) Assignee: Web Guidz, LLC, Wenatchee, WA (US)

( * ) Notice: Subject to any disclaimer, the term of this patent is extended or adjusted under 35 U.S.C. 154(b) by 157 days.

This patent is subject to a terminal disclaimer.

(21) Appl. No.: 15/823,352

(22) Filed: Nov. 27, 2017

(65) Prior Publication Data

US 2019/0160326 A1 May 30, 2019

(51) Int. Cl.
*A63B 21/00* (2006.01)
*A63B 5/20* (2006.01)

(52) U.S. Cl.
CPC ..... *A63B 21/4035* (2015.10); *A63B 5/20* (2013.01); *A63B 2225/09* (2013.01)

(58) Field of Classification Search
CPC .. A63B 5/00; A63B 5/20; A63B 5/205; A63B 5/22; A63B 21/0004; A63B 21/00043; A63B 21/00058; A63B 21/00069; A63B 21/00072; A63B 21/00185; A63B 21/068; A63B 21/15; A63B 21/151; A63B 21/152; A63B 21/22;

(Continued)

(56) References Cited

U.S. PATENT DOCUMENTS 4,330,118 A 5/1982 Race
4,778,173 A 10/1988 Joutras (Continued)

OTHER PUBLICATIONS

Amazon.com: SNODE T18 Self-Locking Crossfit Jump Rope—High Speed Skipping Rope—Light Weighted Speed Rope, Ball Bearing&Anti-Skip Silicon Handle Grips with 2 Speed Rope Cables for Fitness Sports Training Workout : Sports & Outdoors. https://www.amazon.com/SNODE-Self-Locking-Crossfit-Rope-Light-Anti-Skip/dp/B07SXH7HW8/ref=zg_bs_3407981_68?_encoding=UTF8&psc=1&refRID=S9SHV2ES049JC5WNDH0K. Accessed Nov. 10, 2019.

(Continued)

*Primary Examiner* — Gary D Urbiel Goldner
(74) *Attorney, Agent, or Firm* — Jaffery Watson Mendonsa & Hamilton LLP

(57) ABSTRACT

A jump rope handle configured to hold an end portion of a jump rope is provided in accordance with some embodiments. The jump rope handle includes a spindle assembly, a chuck assembly, a lumen through the spindle and chuck assemblies, and a chuck driving mechanism between the spindle and chuck assemblies. The spindle assembly includes a shaft coupled to one or more bearings. The chuck assembly is rotatably coupled to a distal end portion of the spindle assembly. The chuck driving mechanism is configured to open and close a set of jaws of the chuck assembly such as close the set of jaws around the end portion of the jump rope disposed in the lumen up to a proximal end portion of the spindle assembly. A jump rope system including a jump rope and a pair of such jump rope handles is also provided in accordance with some embodiments.

18 Claims, 3 Drawing Sheets

Figure 1:
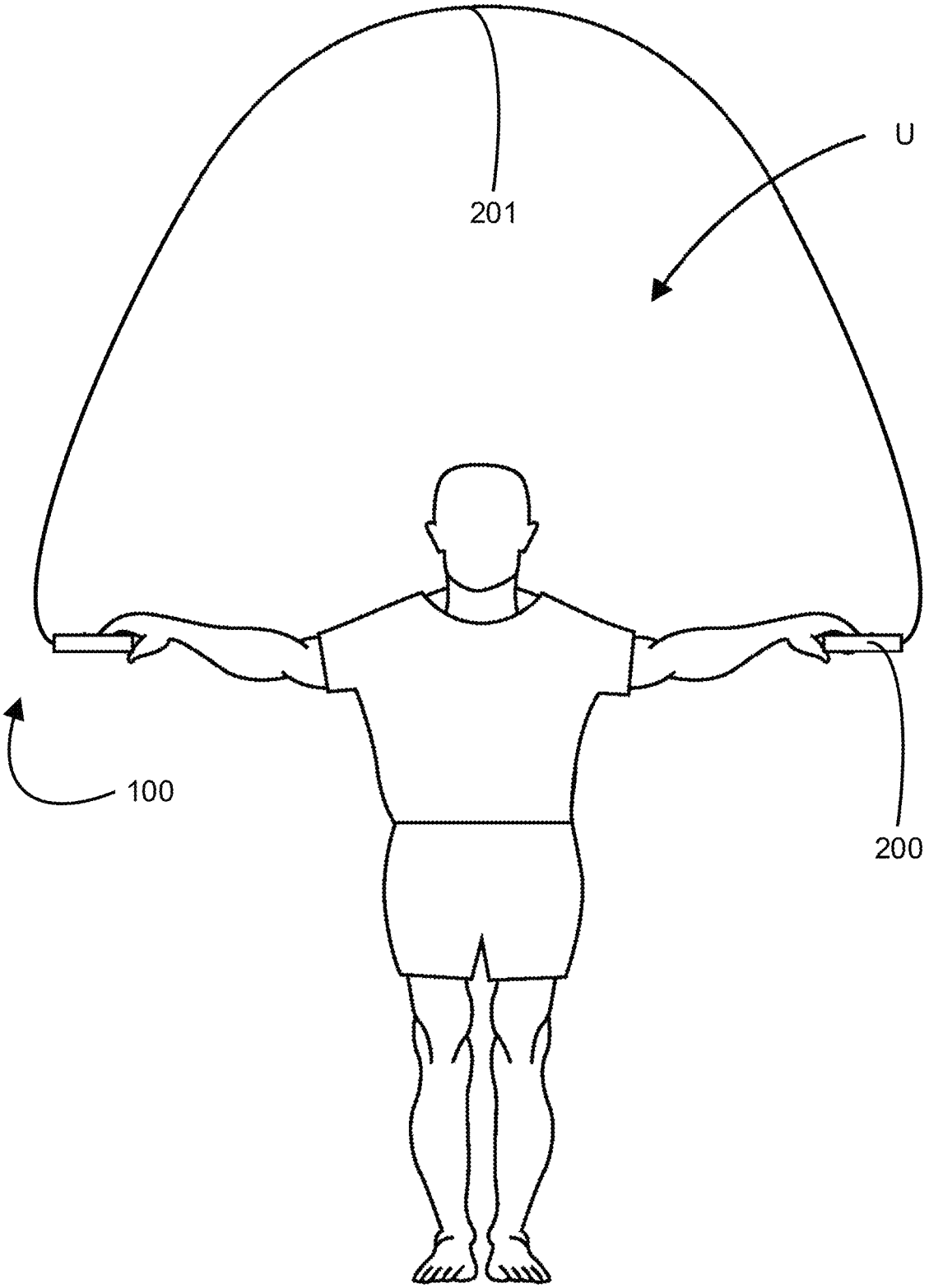

(58) Field of Classification Search
CPC ..... A63B 21/4027; A63B 21/4033; A63B 21/4035; A63B 21/4041; A63B 21/4043; A63B 21/4045; A63B 21/4047; A63B 21/4049; A63B 2208/0204; A63B 2208/0209; A63B 2225/09
See application file for complete search history.

(56) References Cited

U.S. PATENT DOCUMENTS

| | | | | |
|---|---|---|---|---|
| 4,869,492 | A | 9/1989 | Joutras | |
| 5,236,405 | A | 8/1993 | Dohmann | |
| 5,478,297 | A | 12/1995 | Dennis, Jr. | |
| 8,684,892 | B1 * | 4/2014 | Ihli | A63B 5/20 482/81 |
| 2015/0335931 | A1 * | 11/2015 | Jordan | A63B 5/20 482/82 |
| 2018/0361187 | A1 * | 12/2018 | Hopkins | A63B 5/20 |
| 2019/0111294 | A1 * | 4/2019 | Yu | A63B 5/20 |
| 2019/0160319 | A1 * | 5/2019 | Zhang | A63B 5/20 |

OTHER PUBLICATIONS

Youtube.com: Bullet Jump Rope Unboxing (Fidget Spinner Jump Rope), 4:29-4:47. https://www.youtube.com/watch?v=LxYyF3k6Pwl. Published Feb. 25, 2018.
Youtube.com: Bullet Rope—Cable Replacement & Sizing Demonstration. https://www.youtube.com/watch?v=C8crT_6pk7s. Published Apr. 13, 2018.

* cited by examiner

JUMP ROPE HANDLES INCLUDING SYSTEMS AND METHODS THEREOF

BACKGROUND

Jump ropes are used for play, exercise, training, and sport. A typical jump rope has a pair of jump rope handles connected by a length of rope, the swinging of which rope a user controls by the handles. The length of the rope connecting the jump rope handles is often not adjustable in a typical jump rope. For those jump ropes offering an adjustable length of rope, the length of the rope is often only downwardly adjustable such as by cutting the rope, which irreversibly shortens the rope. Furthermore, mechanisms for connecting such shortened lengths of rope to the jump rope handles are often cumbersome requiring tools and time. Provided herein are jump rope handles including systems and methods thereof that address the foregoing.

SUMMARY

Provided herein is a jump rope handle including, in some embodiments, a spindle assembly, a chuck assembly, and a chuck driving mechanism between the spindle assembly and the chuck assembly. The spindle assembly includes a shaft coupled to one or more bearings. The chuck assembly is rotatably coupled to a distal end portion of the spindle assembly, and the chuck assembly includes a set of jaws. The chuck driving mechanism is configured to open and close the set of jaws.

In some embodiments, the jump rope handle further includes a lumen. The lumen extends from a distal end of the chuck assembly, through the distal end portion of the spindle assembly, and to a proximal end portion of the spindle assembly. The lumen is configured to accommodate an end portion of a jump rope.

In some embodiments, the lumen extends through the shaft and at least one bearing of the one or more bearings.

In some embodiments, the shaft is coupled to two rolling-element bearings. A first bearing of the two bearings is around a distal end portion of the shaft, while a second bearing of the two bearings is around a proximal end portion of the shaft.

In some embodiments, the spindle assembly further includes a doubly threaded fastener and a collar. The fastener is in a distal end portion of the shaft, and the collar is around a distal end portion of the fastener.

In some embodiments, the chuck assembly further includes a drive piece disposed in a body of the chuck assembly. A base piece forms the body of the chuck assembly with a chuck hood, and the drive piece is between the set of jaws and the base piece.

In some embodiments, the chuck driving mechanism includes a doubly threaded fastener in a distal end portion of the shaft, a collar around a distal end portion of the fastener, a drive piece disposed in a body of the chuck assembly, and a base piece forming the body of the chuck assembly with a chuck hood.

In some embodiments, the chuck driving mechanism is configured to close the set of jaws upon holding the spindle assembly stationary by the collar and screwing the chuck assembly onto the fastener. Holding the spindle assembly stationary and screwing the chuck assembly onto the fastener drives a distal end of the fastener through a threaded bore of the base piece and into the drive piece. The distal end of the fastener pushes the drive piece and, thus, the set of jaws along a tapered bore of the chuck hood toward a distal end of the chuck assembly.

In some embodiments, the jump rope handle further includes a housing assembly rotatably coupled to the spindle assembly. The housing assembly includes a spindle housing, a grip over the spindle housing, and a flared end piece in a proximal end portion of the spindle housing. The spindle housing is configured to accommodate at least a portion of the spindle assembly.

Also provided herein is a jump rope handle including, in some embodiments, a spindle assembly, a chuck assembly, a lumen through the spindle assembly and the chuck assembly, and a chuck driving mechanism between the spindle assembly and the chuck assembly. The spindle assembly includes a shaft coupled to two ball bearings. A first bearing of the two bearings is around a distal end portion of the shaft. A second bearing of the two bearings is around a proximal end portion of the shaft. The spindle assembly also includes a doubly threaded fastener in the distal end portion of the shaft, and a collar around a distal end portion of the fastener. The chuck assembly is rotatably coupled to a distal end portion of the spindle assembly. The chuck assembly includes a drive piece disposed in a body of the chuck assembly. A base piece forms the body of the chuck assembly with a chuck hood, and the drive piece is between a set of jaws and the base piece. The lumen extends from a distal end of the chuck assembly, through the distal end portion of the spindle assembly, and to a proximal end portion of the spindle assembly. The chuck driving mechanism is configured to close the set of jaws around an end portion of a jump rope disposed in the lumen up to the proximal end portion of the spindle assembly.

In some embodiments, the chuck driving mechanism includes the fastener and the collar of the spindle assembly and the drive piece and the base piece of the chuck assembly.

In some embodiments, the chuck driving mechanism is configured to close the set of jaws upon holding the spindle assembly stationary by the collar and screwing the chuck assembly onto the fastener. Holding the spindle assembly stationary and screwing the chuck assembly onto the fastener drives a distal end of the fastener through a threaded bore of the base piece and into the drive piece. The distal end of the fastener pushes the drive piece and, thus, the set of jaws along a tapered bore of the chuck hood toward a distal end of the chuck assembly.

In some embodiments, the jump rope handle further includes a housing assembly including a spindle housing rotatably coupled to the spindle assembly. The housing assembly further includes a grip over the spindle housing, and a flared end piece in a proximal end portion of the spindle housing. The housing assembly is configured to accommodate the spindle assembly excepting the collar around the distal end portion of the fastener.

Also provided herein is a jump rope system including, in some embodiments, a jump rope and a jump rope handle configured to hold an end portion of the jump rope. The jump rope handle includes a spindle assembly, a chuck assembly, a lumen through the spindle assembly and the chuck assembly, and a chuck driving mechanism between the spindle assembly and the chuck assembly. The spindle assembly includes a shaft coupled to one or more bearings. The chuck assembly is rotatably coupled to a distal end portion of the spindle assembly, and the chuck assembly includes a set of jaws. The lumen extends from a distal end of the chuck assembly to a proximal end portion of the spindle assembly. The chuck driving mechanism is configured to open and close the set of jaws such as close the set of jaws around the end portion of the jump rope disposed in the lumen up to the proximal end portion of the spindle assembly.

In some embodiments, the lumen extends through the shaft and at least a first bearing of two rolling-element bearings. The first bearing of the two bearings is around a distal end portion of the shaft, while a second bearing of the two bearings is around a proximal end portion of the shaft.

In some embodiments, wherein the lumen is configured to accommodate a length of the end portion of the jump rope ranging from about 10 cm to about 20 cm. The lumen is also configured to accommodate a diameter of the jump rope ranging from about 1 mm to about 6 mm.

In some embodiments, the spindle assembly further includes a doubly threaded fastener and a collar. The fastener is in a distal end portion of the shaft, and the collar is around a distal end portion of the fastener.

In some embodiments, the chuck assembly further includes a drive piece disposed in a body of the chuck assembly. A base piece forms the body of the chuck assembly with a chuck hood, and the drive piece is between the set of jaws and the base piece.

In some embodiments, the chuck driving mechanism includes the fastener and the collar of the spindle assembly and the drive piece and the base piece of the chuck assembly.

In some embodiments, the chuck driving mechanism is configured to close the set of jaws upon holding the spindle assembly stationary by the collar and screwing the chuck assembly onto the fastener. Holding the spindle assembly stationary and screwing the chuck assembly onto the fastener drives a distal end of the fastener through a threaded bore of the base piece and into the drive piece. The distal end of the fastener pushes the drive piece and, thus, the set of jaws along a tapered bore of the chuck hood toward the distal end of the chuck assembly.

In some embodiments, the jump rope handle further includes a housing assembly including a spindle housing configured to accommodate at least a portion of the spindle assembly. The housing assembly further includes a grip over the spindle housing, and a flared end piece in a proximal end portion of the spindle housing. The housing assembly is rotatably coupled to the spindle assembly.

DRAWINGS

FIG. 1 provides a schematic illustrating a user with a jump rope system in accordance with some embodiments.

Figure 2:
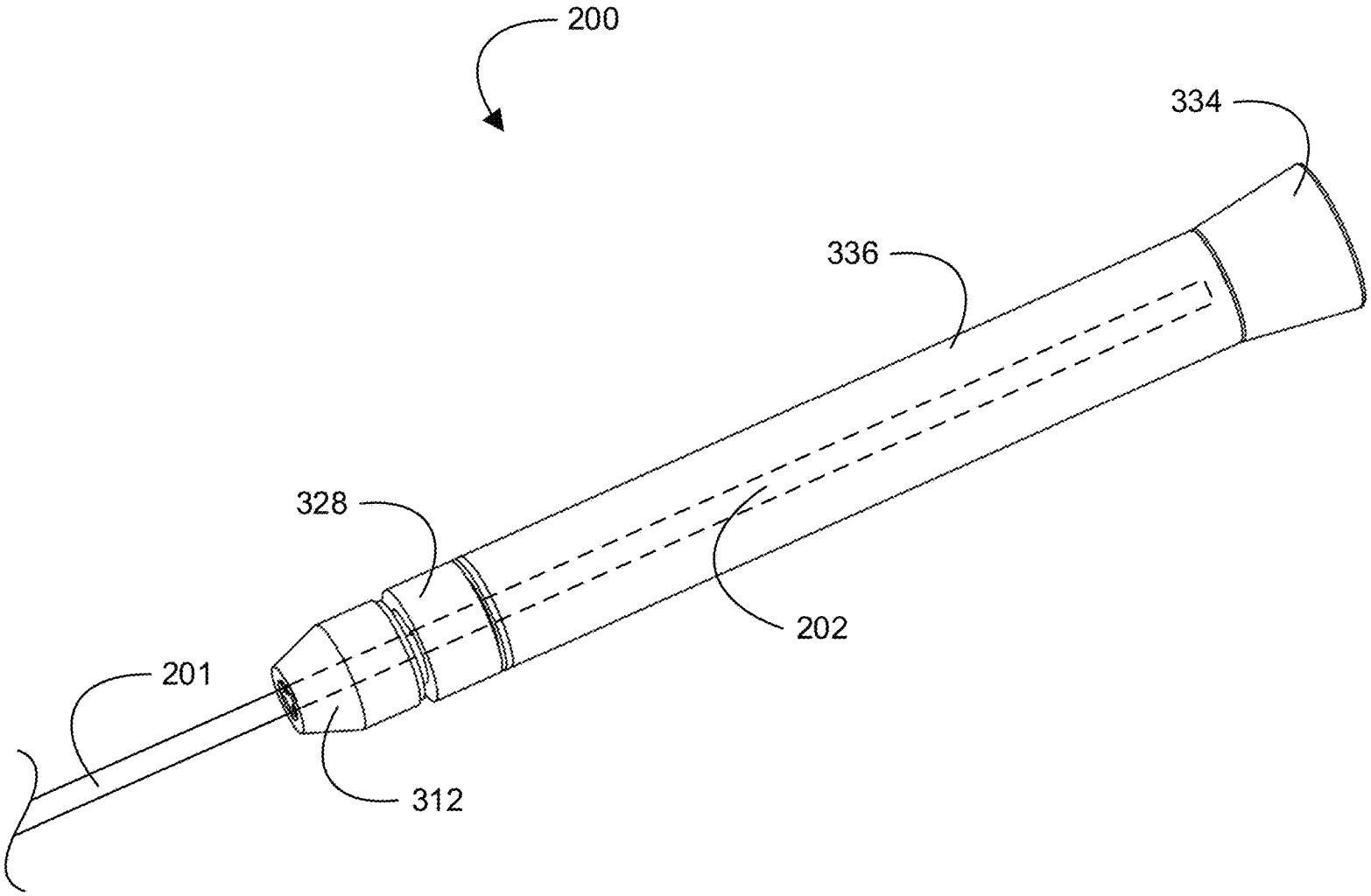

FIG. 2 provides a schematic illustrating a handle of the jump rope system in accordance with some embodiments.

Figure 3:
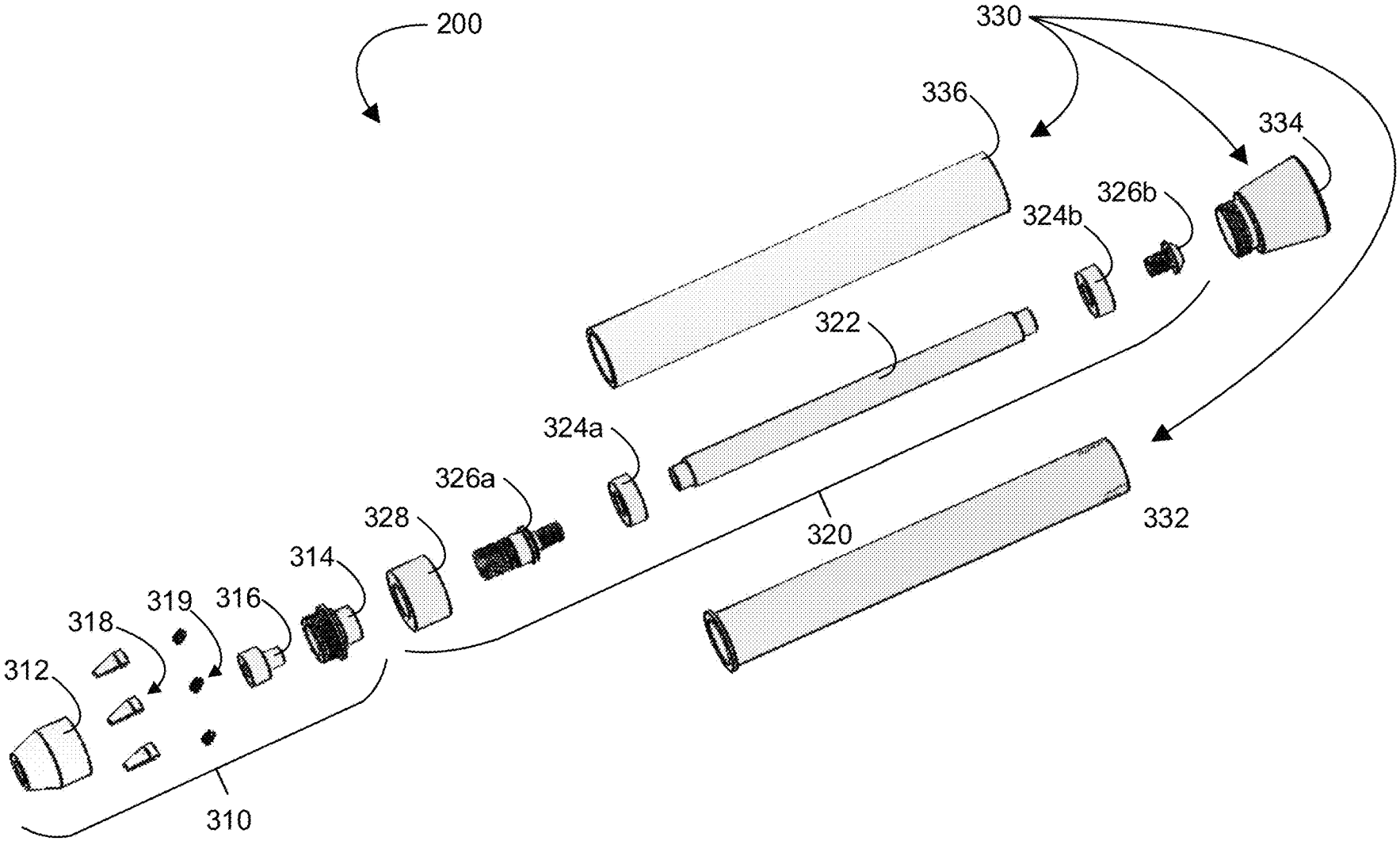

FIG. 3 provides a schematic illustrating an exploded view of the handle of FIG. 2.

DESCRIPTION

Before some particular embodiments are provided in greater detail, it should be understood that the particular embodiments provided herein do not limit the scope of the concepts provided herein. It should also be understood that a particular embodiment provided herein can have features that can be readily separated from the particular embodiment and optionally combined with or substituted for features of any of a number of other embodiments provided herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "proximal," "distal," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

With respect to "proximal," a "proximal portion" or a "proximal end portion" of, for example, a jump rope handle provided herein includes a portion of the handle nearest a user or directed toward the user when the handle is held and used as intended. (See, for example, FIG. 1.) Likewise, a "proximal length" of, for example, the handle includes a length of the handle nearest the user or directed toward the user when the handle is held and used as intended. A "proximal end" of, for example, the handle includes an end of the handle nearest the user or directed toward the user when the handle is held and used as intended. The proximal portion, the proximal end portion, or the proximal length of the handle can include the proximal end of the handle; however, the proximal portion, the proximal end portion, or the proximal length of the handle need not include the proximal end of the handle. That is, unless context suggests otherwise, the proximal portion, the proximal end portion, or the proximal length of the handle is not a terminal portion or terminal length of the handle.

With respect to "distal," a "distal portion" or a "distal end portion" of, for example, a jump rope handle provided herein includes a portion of the handle farthest from a user or directed away from the user when the handle is held and used as intended. (See, for example, FIG. 1.) Likewise, a "distal length" of, for example, the handle includes a length of the handle farthest from the user or directed away from the user when the handle is held and used as intended. A "distal end" of, for example, the handle includes an end of the handle farthest from the user or directed away from the user when the handle is held and used as intended. The distal portion, the distal end portion, or the distal length of the handle can include the distal end of the handle; however, the distal portion, the distal end portion, or the distal length of the handle need not include the distal end of the handle. That is, unless context suggests otherwise, the distal portion, the distal end portion, or the distal length of the handle is not a terminal portion or terminal length of the handle.

Unless defined otherwise, all technical and scientific terms used herein have the same meaning as commonly understood by those of ordinary skill in the art.

As set forth herein above, a typical jump rope has a pair of jump rope handles connected by a length of rope, the swinging of which rope a user controls by the handles. The length of the rope connecting the jump rope handles is often not adjustable in a typical jump rope. For those jump ropes offering an adjustable length of rope, the length of the rope is often only downwardly adjustable such as by cutting the rope, which irreversibly shortens the rope. Furthermore, mechanisms for connecting such shortened lengths of rope to the jump rope handles are often cumbersome requiring tools and time. Provided herein are jump rope handles including systems and methods thereof that address the foregoing.

For example, a jump rope handle configured to hold an end portion of a jump rope is provided in accordance with some embodiments. The jump rope handle includes a spindle assembly, a chuck assembly, a lumen through the spindle assembly and the chuck assembly, and a chuck driving mechanism between the spindle assembly and the chuck assembly, which chuck driving mechanism can be toolless or keyless. The spindle assembly includes a shaft coupled to one or more bearings. The chuck assembly is rotatably coupled to a distal end portion of the spindle assembly. The lumen extends from a distal end of the chuck assembly to a proximal end portion of the spindle assembly. The chuck driving mechanism is configured to open and close a set of jaws of the chuck assembly such as close the set of jaws around the end portion of the jump rope disposed in the lumen, a length of which end portion of the jump rope can be adjusted up to the proximal end portion of the spindle assembly to match a full length of the lumen. This obviates having to cut the jump rope. A jump rope system including a jump rope and a pair of such jump rope handles is also provided in accordance with some embodiments.

FIG. 1 provides a schematic illustrating a user U with a jump rope system 100, or jump rope 100, in accordance with some embodiments. As shown, the jump rope system 100 includes a pair of jump rope handles connected by a jump rope 201. One jump rope handle of the pair of jump rope handles is designated as handle 200 in FIGS. 1-3.

FIG. 2 provides a schematic illustrating the jump rope handle 200 of the jump rope system 100 in accordance with some embodiments, and FIG. 3 provides a schematic illustrating an exploded view of the handle 200 of FIG. 2. As shown, the jump rope handle 200 includes a chuck assembly 310, a spindle assembly 320, a lumen 202 through the chuck assembly 310 and the spindle assembly 320, and a housing assembly 330 around at least a portion of the spindle assembly 320.

The chuck assembly 310 includes a chuck hood 312 and a base piece 314 forming a body of the chuck assembly 310. An inner perimeter of the chuck hood 312 and an outer perimeter of the base piece 314 are mutually threaded for screwing the chuck hood 312 and the base piece 314 together to form the body of the chuck assembly 310. An inner perimeter of the base piece 314 is also threaded providing a threaded bore or through hole of the base piece 314 for mounting the chuck assembly 310 on the spindle assembly 320 and participating in the chuck driving mechanism.

Within the body of the chuck assembly 310 is a drive piece 316, a set of jaws 318 (e.g., a 2-, 3-, 4-, 5-, or 6-jawed set of jaws 318), and a set of springs 319. The drive piece 316 is disposed between the set of jaws 318 and the base piece 314, the drive piece 316 supporting the set of jaws 318 at a base thereof. The inner perimeter of the chuck hood 312 distal of any threading is tapered providing a tapered bore of the chuck hood 312, against which tapered bore the set of jaws 318 are held with an outwardly directed radial force provided by the set of springs 319. Each jaw of the set of jaws 318 is held apart from an adjacent jaw by an intervening compression spring of the set of springs 319, thereby providing the outwardly directed radial force that holds the set of jaws 318 apart and against the tapered bore of the chuck hood 312. As an increasing load is applied to the set of springs 319, such as by closing the set of jaws 318 by way of the chuck driving mechanism, each spring of the set of springs 319 compresses and shortens under the increasing load allowing adjacent jaws of the set of jaws 318 to approach to each other. A tool or key is not needed to close the set of jaws 318 of the chuck assembly 310; that is, the chuck assembly 310 can be toolless or keyless as shown in FIGS. 2 and 3.

In some embodiments, the chuck assembly 310 is configured as a collet chuck assembly including a tapered receiving sleeve, a collet proper configured to insert into the receiving sleeve, and a collar configured to hold the collet proper in the receiving sleeve such as by friction or screwing the collar over the receiving sleeve including the collet proper.

The spindle assembly 320 includes a shaft 322 coupled to one or more bearings such as a pair of bearings 324. The pair of bearings 324 includes a first bearing **324*a* around a distal end portion of the shaft 322 and a second bearing 324*b* around a proximal end portion of the shaft 322. Each end portion of the distal end portion and the proximal end portion of the shaft 322 includes a recessed outer perimeter having a smaller outer diameter than an outer diameter of a medial portion of the shaft 322. The smaller outer diameter matches an inner diameter of a bearing within an allowance for coupling the shaft 322 to the pair of bearings 324** with an interference fit.

Each bearing of the pair of bearings 324 can be a rolling-element bearing having rolling elements between inner and outer races, the rolling elements independently selected for each bearing from balls and rollers, the rollers including cylindrical rollers, spherical rollers, geared rollers, tapered rollers, or needle rollers. For example, each bearing of the pair of bearings 324 can be a ball bearing having balls between inner and outer races. In some embodiments, a rolling-element bearing such as a ball bearing has a small profile with dimensions including an outer diameter of 12.7 mm, an inner diameter of 6.35 mm, and a height or thickness of 4.76 mm. The small profile of each bearing of the pair of bearings 324 facilitates disposal of the spindle assembly 320 in the housing assembly 330, which housing assembly 330 is configured to comfortably fit is a user's hand.

Notwithstanding an extended length of the shaft 322 between the pair of bearings 324, coupling the shaft 322 to the pair of bearings 324 with the bearings around the end portions of the shaft 322 reduces or eliminates precession of the shaft 322 when axial loads are applied such as by swinging the rope 201 when the rope 201 is chucked in the chuck assembly 310. In combination with axial load-compensating placement of the pair of bearings 324, which also serves to reduce friction, the rolling-element bearings enable an efficient spinning of the spindle assembly 320.

Each end portion of the distal end portion and the proximal end portion of the shaft 322 also includes a threaded inner perimeter for fastening the pair of bearings 324 to the shaft 322. As shown in FIG. 3, the pair of bearings 324 are fastened to the shaft 322 with a pair of threaded fasteners 326 including a first fastener **326*a* for fastening the first bearing 324*a* around the distal end portion of the shaft 322 and a second fastener 326*b* for fastening the second bearing 324*b* around the proximal end portion of the shaft 322. The first fastener 326*a* is a doubly threaded fastener configured to screw a distal end of the first fastener 326*a* into the threaded bore or through hole of the base piece 314 for mounting the chuck assembly 310 on the spindle assembly 320 and participating in the chuck driving mechanism. A collar 328 over a distal end portion of the first fastener 326*a* is disposed between the chuck assembly 310 and the shaft 322 within the housing assembly 330. The collar 328 is set with a gap between the chuck assembly 310 and housing assembly 330 such that the collar 328 does not rub or otherwise interfere with the spinning of the spindle assembly 320**.

As shown in FIG. 2, the lumen 202 of the jump rope handle 200 extends from a distal end of the jump rope handle 200 to a proximal end portion of the jump rope handle 200. More particularly, the lumen 202 extends from a distal end of the chuck assembly 310 to a proximal end portion of the spindle assembly 320. As such, the lumen 202 extends through a combination of i) the chuck hood 312, the set of jaws 318, the set of springs 319, the drive piece 316, and the base piece 314 of the chuck assembly 310 and ii) the first fastener 326*a*, the collar 328, and at least the first bearing 324*a* and the distal end portion of the shaft 322 of the spindle assembly. Depending upon an extent to which the second fastener 326*b* is screwed into the proximal end portion of the shaft 322, the lumen 202 can further extend through at least a portion of the second bearing 324*b* at the proximal end portion of the shaft 322. In some embodiments, the second fastener 326*b* includes a bore that extends the lumen 202 through the second bearing 324*b* to a proximal end of the shaft 322 coextensive with a head of the fastener 326*b*.

The lumen 202 is configured to accommodate an end portion of the rope 201 such as a length of the rope 201 in excess of that needed or desired by the user U (e.g., a jumper). In some embodiments, the lumen 202 has a length of at least 2 cm, 4 cm, 6 cm, 8 cm, 10 cm, 12 cm, 14 cm, 16 cm, 18 cm, or 20 cm to accommodate the end portion of the rope 201. In some embodiments, the lumen 202 has a length of no more than 20 cm, 18 cm, 16 cm, 14 cm, 12 cm, 10 cm, 8 cm, 6 cm, 4 cm, or 2 cm to accommodate the end portion of the rope 201. In some embodiments, the lumen 202 has a length of at least 2 cm to no more than 20 cm, including a length of at least 10 cm to no more than 20 cm, such as a length of at least 12 cm to no more than 18 cm, for example, a length of at least 12 cm to no more than 16 cm to accommodate the end portion of the rope 201. As such, the user U can adjust the length of rope 201 without cutting the rope 201 to provide shorter lengths for exercise or training, longer lengths for tricks during play, or an appropriate length for additional users.

The lumen 202 is also configured to accommodate any of several diameters of the end portion of the rope 201. In some embodiments, the lumen 202 has a minimum diameter of at least 1 mm, 2 mm, 3 mm, 4 mm, 5 mm, or 6 mm to accommodate the end portion of the rope 201. In some embodiments, the lumen 202 has a minimum diameter of no more than 6 mm, 5 mm, 4 mm, 3 mm, 2 mm, or 1 mm to accommodate the end portion of the rope 201. In some embodiments, the lumen 202 has a minimum diameter of at least 1 mm to no more than 6 mm, including a minimum diameter of at least 2 mm to no more than 6 mm, such as a minimum diameter at least 3 mm to no more than 6 mm, for example, a minimum diameter of at least 4 mm to no more than 6 mm to accommodate the end portion of the rope 201. As such, the user U can switch out the rope 201 to provide a thicker rope for exercise or training, a thinner rope for competition or tricks during play, or the like.

The chuck driving mechanism or chucking mechanism is between the chuck assembly 310 and the spindle assembly 320. More specifically, the chuck driving mechanism includes at least the first or doubly threaded fastener 326*a* in the distal end portion of the shaft 322, the collar 328 around the distal end portion of the doubly threaded fastener 326*a*, the drive piece 316 disposed in the body of the chuck assembly 310, and the base piece 314, which forms the body of the chuck assembly 310 with the chuck hood 312.

The chuck driving mechanism is configured to close the set of jaws 318 around the end portion of the jump rope 201, which jump rope can be disposed in the lumen 202 up to the proximal end portion of the spindle assembly 320. More specifically, the chuck driving mechanism is configured to close the set of jaws 318 upon holding the spindle assembly 320 stationary by the collar 328 and screwing the chuck assembly 310 toward or otherwise onto or further onto the doubly threaded fastener 326*a*. Holding the spindle assembly 320 stationary and screwing the chuck assembly 310 toward the doubly threaded fastener 326*a* drives a distal end of the doubly threaded fastener 326*a* or a bolt thereof through the threaded bore of the base piece 314 and into the drive piece 316. The distal end of the doubly threaded fastener 326*a* pushes the drive piece 316 and, thus, the drive piece-supported set of jaws 318 along the tapered bore of the chuck hood 312, toward the distal end of the chuck assembly 310, and out of the distal end of the chuck assembly 310 depending upon a diameter of the jump rope 201. An outer perimeter of the collar 328 and an outer perimeter of the chuck hood 312 can each be textured to facilitate holding the spindle assembly 320 stationary and screwing the chuck assembly 310 toward the doubly threaded fastener 326*a*.

The chuck driving mechanism is further configured to open the set of jaws 318 to release the end portion of the jump rope 201. More specifically, the chuck driving mechanism is configured to open the set of jaws 318 upon holding the spindle assembly 320 stationary by the collar 328 and screwing the chuck assembly 310 away from the doubly threaded fastener 326*a*. Holding the spindle assembly 320 stationary and screwing the chuck assembly 310 away from the doubly threaded fastener 326*a* pulls the distal end of the doubly threaded fastener 326*a* or the bolt thereof back through the threaded bore of the base piece 314 and away from both the drive piece 316 and the drive piece-supported set of jaws 318, thereby allowing the set of jaws 318 to relax.

The housing assembly 330 is rotatably coupled to the spindle assembly 320 and configured to accommodate at least a portion of the spindle assembly 320. The housing assembly 330 includes a spindle housing 332, a grip 336 (e.g., a foam grip) over the spindle housing 332, and a flared end piece 334 configured to keep the user's hand from slipping off the proximal end portion of the housing assembly 330 or the jump rope handle 200. An inner perimeter of the spindle housing 332 and an outer perimeter of the end piece 334 are mutually threaded for screwing the end piece 334 and the spindle housing 332 together to form a body of the housing assembly 330.

The jump rope 201 can be any of a number of different ropes, cables, cords, wires, lines, laces, or the like suitable for demands of play, exercise, training, or sport with the jump rope system 100. For example, the jump rope 201 can be a bare or polymer-coated wire cable (e.g., nylon-coated wire cable or polytetrafluoroethylene-coated wire cable) or an entirely polymer-based cable (e.g., polyvinyl chloride-based cable). The jump rope 201 can have a diameter that ranges from, for example, 1 mm to 4 mm.

A jump rope system including at least one jump rope (e.g., the jump rope 201) and a pair of jump rope handles (e.g., each jump rope handle of the pair of jump rope handles being the jump rope handle 200) can be packaged or otherwise provided in a package or kit. The package can be designed for an activity such as play, exercise, training, or sport, or the package can be designed for a combination of the foregoing activities. Accordingly, the package can further include a spare jump rope identical to the at least one jump rope for a same type of activity, or the package can include a second jump rope different from the at least one jump rope for a different type of activity. For example, the at least one jump rope can be for exercise or training while the second jump rope can be for tricks during play. Any one or more of the jump ropes can be provided in a standard length (e.g., 10 feet) for a one-time adjustment, if needed, before chucking the jump rope in the chucking assemblies of the pair of jump rope handles. Information such as instructions or tips for using the jump rope system can also be included in the package. Such information can include tips for appropriate jump rope lengths for different activities.

Components of the chuck assembly 310 such as the chuck hood 312, components of the spindle assembly 320 such as the spindle shaft 322 and the collar 328, and components of the housing assembly 330 such as the spindle housing 332 and the end piece 334 can be machined from a metal or alloy including aluminum, titanium, or stainless steel. Alternatively, one or more of such components can be molded from a high-density polymer such as high-density polyethylene ("HDPE") or a composite such as a fiber-reinforced polymer (e.g., carbon fiber-reinforced polymer). Other components of the chuck assembly 310 and the spindle assembly 320 can be fashioned from any of a number of metals or alloys including, but not limited to, iron, steel, stainless steel, or zinc alloy as appropriate. For example, the set of jaws 318 can be a high-strength zinc alloy. The grip 336 can be molded from polyvinyl chloride.

While some particular embodiments have been provided herein, and while the particular embodiments have been provided in some detail, it is not the intention for the particular embodiments to limit the scope of the concepts presented herein. Additional adaptations and/or modifications can appear to those of ordinary skill in the art, and, in broader aspects, these adaptations and/or modifications are encompassed as well. Accordingly, departures may be made from the particular embodiments provided herein without departing from the scope of the concepts provided herein.

What is claimed is:

1. A jump rope handle, comprising:

a spindle assembly including a shaft coupled to one or more bearings, a doubly threaded fastener in a distal end portion of the shaft, and a collar around a distal end portion of the doubly threaded fastener;

a chuck assembly rotatably coupled to a distal end portion of the spindle assembly, the chuck assembly including a set of jaws; and a chuck driving mechanism that includes the doubly threaded fastener and the collar of the spindle assembly and a portion of the chuck assembly, the chuck driving mechanism configured to open and close the set of jaws.

2. The jump rope handle of claim 1, further comprising:

a lumen extending from a distal end of the chuck assembly, through the distal end portion of the spindle assembly, and to a proximal end portion of the spindle assembly, the lumen configured to accommodate an end portion of a jump rope.

3. The jump rope handle of claim 2, wherein the lumen extends through the shaft and at least one bearing of the one or more bearings.

4. The jump rope handle of claim 1, wherein the one or more bearings are two rolling-element bearings, a first bearing of the two rolling-element bearings around a distal end portion of the shaft, and a second bearing of the two rolling-element bearings around a proximal end portion of the shaft.

5. The jump rope handle of claim 1, further comprising:

a housing assembly including a spindle housing configured to accommodate at least a portion of the spindle assembly, a grip over the spindle housing, and a flared end piece in a proximal end portion of the spindle housing, the housing assembly rotatably coupled to the spindle assembly.

6. The jump rope handle of claim 1, further comprising:

a lumen extending from a distal end of the chuck assembly, through the distal end portion of the spindle assembly, and to a proximal end portion of the spindle assembly, the lumen configured to accommodate an end portion of a jump rope disposed in the lumen up to the proximal end portion of the spindle assembly, wherein the one or more bearings are two ball bearings and the spindle assembly further includes a first bearing of the two ball bearings around a distal end portion of the shaft, and a second bearing of the two ball bearings around a proximal end portion of the shaft; and wherein the chuck assembly further includes a drive piece between the set of jaws and a base piece forming a body of the chuck assembly with a chuck hood.

7. The jump rope handle of claim 6, wherein the portion of the chuck assembly included in the chuck driving mechanism comprises the drive piece and the base piece.

8. The jump rope handle of claim 6, wherein the chuck driving mechanism is configured to close the set of jaws upon holding the spindle assembly stationary by the collar and screwing the chuck assembly onto the doubly threaded fastener, which drives a distal end of the doubly threaded fastener through a threaded bore of the base piece and into the drive piece, thereby pushing the set of jaws along a tapered bore of the chuck hood toward the distal end of the chuck assembly.

9. The jump rope handle of claim 6, further comprising:

a housing assembly including a spindle housing rotatably coupled to the spindle assembly, a grip over the spindle housing, and a flared end piece in a proximal end portion of the spindle housing, the housing assembly configured to accommodate the spindle assembly accepting the collar around the distal end portion of the doubly threaded fastener.

10. A jump rope handle, comprising:

a spindle assembly including a shaft coupled to one or more bearings, a fastener coupled to a distal end of the shaft, and a collar around the fastener; and a chuck assembly rotatably coupled to the fastener, the chuck assembly including a set of jaws, and a drive piece disposed in a body of the chuck assembly, the drive piece between the set of jaws and a base piece forming the body of the chuck assembly with a chuck hood;

wherein screwing the chuck assembly onto the fastener drives a distal end of the fastener through the base piece and into the drive piece thereby pushing the set of jaws toward a distal end of the chuck assembly.

11. The jump rope handle of claim 10, wherein an inner perimeter of the chuck hood and an outer perimeter of the base piece are mutually threaded for screwing the chuck hood and the base piece together to form the body of the chuck assembly.

12. The jump rope handle of claim 10, wherein holding the spindle assembly stationary by the collar and screwing the chuck assembly onto the fastener drives the distal end of the fastener through a threaded bore of the base piece and into the drive piece, thereby pushing the set of jaws along a tapered bore of the chuck hood toward the distal end of the chuck assembly.

13. A jump rope system, comprising:

a) a jump rope; and b) a jump rope handle including:

a spindle assembly including a shaft coupled to one or more bearings, a doubly threaded fastener in a distal end portion of the shaft, and a collar around a distal end portion of the doubly threaded fastener;

a chuck assembly rotatably coupled to a distal end portion of the spindle assembly, the chuck assembly including a set of jaws;

a lumen extending from a distal end of the chuck assembly to a proximal end portion of the spindle assembly; and a chuck driving mechanism that includes the doubly threaded fastener and the collar of the spindle assembly and a portion of the chuck assembly, the chuck driving mechanism configured to open and close the set of jaws around the jump rope.

14. The jump rope system of claim 13, wherein the one or more bearings are two rolling-element bearings, wherein the lumen extends through the shaft and at least a first bearing of the two rolling-element bearings, the first bearing of the two rolling-element bearings around a distal end portion of the shaft, and a second bearing of the two rolling-element bearings around a proximal end portion of the shaft.

15. The jump rope system of claim 13, wherein the lumen is configured to accommodate a length of an end portion of the jump rope ranging from about 10 cm to about 20 cm and a diameter of the jump rope ranging from about 1 mm to about 6 mm.

16. The jump rope system of claim 13, wherein the chuck assembly further includes a drive piece disposed in a body of the chuck assembly, the drive piece between the set of jaws and a base piece forming the body of the chuck assembly with a chuck hood, wherein the portion of the chuck assembly included in the chuck driving mechanism comprises the drive piece and the base piece.

17. The jump rope system of claim 16, wherein the chuck driving mechanism is configured to close the set of jaws upon holding the spindle assembly stationary by the collar and screwing the chuck assembly onto the doubly threaded fastener, which drives a distal end of the doubly threaded fastener through a threaded bore of the base piece and into the drive piece, thereby pushing the set of jaws along a tapered bore of the chuck hood toward the distal end of the chuck assembly.

18. The jump rope system of claim 13, the jump rope handle further comprising:

a housing assembly including a spindle housing configured to accommodate at least a portion of the spindle assembly, a grip over the spindle housing, and a flared end piece in a proximal end portion of the spindle housing, the housing assembly rotatably coupled to the spindle assembly.

* * * * *